US006115019A

United States Patent [19]

Perner

[11] Patent Number: 6,115,019

[45] Date of Patent: Sep. 5, 2000

[54] REGISTER PIXEL FOR LIQUID CRYSTAL DISPLAYS

[75] Inventor: Frederick A. Perner, Palo Alto, Calif.

[73] Assignee: Agilent Technologies, Palo Alto, Calif.

[21] Appl. No.: 09/030,245

[22] Filed: Feb. 25, 1998

(Under 37 CFR 1.47)

[51] Int. Cl.[7] ..... G09G 3/36; G09G 5/00

[52] U.S. Cl. ..... 345/98; 345/205; 345/90

[58] Field of Search ..... 345/98, 97, 205, 345/206, 90, 92

[56] References Cited

U.S. PATENT DOCUMENTS

| | | | |
|---|---|---|---|
| 4,432,610 | 2/1984 | Kobayashi et al. | 350/331 R |
| 5,339,090 | 8/1994 | Crossland et al. | 345/90 |
| 5,471,225 | 11/1995 | Parks | 345/98 |
| 5,627,557 | 5/1997 | Yamaguchi et al. | 345/90 |
| 5,945,972 | 8/1999 | Okumura et al. | 345/98 |
| 5,952,991 | 9/1999 | Akiyama | 345/98 |
| 5,977,940 | 11/1999 | Akiyama et al. | 345/94 |

*Primary Examiner*—Mark R. Powell
*Assistant Examiner*—Ryan Yang

[57] ABSTRACT

A display device and a method of driving liquid crystals in an array of pixels of the display device include providing dual port memory cells that isolate write operations to the pixels from read operations within the pixels. Preferably, each pixel has an array of integrated dual port memory cells, with the number of cells in the array being equal to the number of bits per pixel within each frame of pixel data. The dual port memory cell may be an electrical series connection of a bit-storage device having write access circuitry (e.g., a write access transistor) on one side and read access circuitry (e.g., two read access transistors) on the opposite side. Such a series connection of devices enables the rate of driving the liquid crystal to be set independently from the rate of receiving pixel data at the pixels.

16 Claims, 6 Drawing Sheets

REGISTER PIXEL FOR LIQUID CRYSTAL DISPLAYS

TECHNICAL FIELD

The invention relates generally to liquid crystal displays and more particularly to a liquid crystal display capable of storing video data.

DESCRIPTION OF THE RELATED ART

Liquid crystal displays (LCDS) have become a popular form of electronic displays. LCDs are composed of liquid crystals which are positioned between two pieces of glass. The crystals can be aligned such that in a normal state, light easily propagates through the liquid crystals. However, when an electrical field is present, the liquid crystals alter their alignment, greatly reducing the amount of light passing through the crystals. By applying an electrical field at different "pixels" or discrete regions on the LCD, an image can be formed on the LCD. An LCD can have more than 1,228,800 pixels. The resolution of the LCD is directly related to the density of pixels in the LCD array.

There are a number of alternative types of liquid crystals utilized commercially in LCDs. A first major type is referred to as twisted nematic liquid crystals. LCDs with twisted nematic liquid crystals produce pictures with high contrast. However, LCDs with twisted nematic liquid crystals have relatively narrow viewing angles, as well as slow molecular rotation times. A second type of liquid crystals is referred to as ferroelectric liquid crystals. LCDs with ferroelectric liquid crystals have wider viewing angles, because of their small cell gaps of 1 to 2 microns. In addition, ferroelectric liquid crystal displays (FLCDs) have a faster molecular rotation speed, typically in the range of 50 to 100 micro seconds.

A typical FLCD includes a display chip covered with a structure containing the ferroelectric liquid crystals, an illuminator, and viewing optics. The FLCD is supported by a host computer and an external frame buffer memory. In order to display a color image on the FLCD, a frame of image data is transferred from the host computer to the external frame buffer memory. The external frame buffer memory supplies multi-bit pixel data to each pixel in the FLCD. The color image represented by the frame of pixel data is displayed on the FLCD as a result of a time sequential process of loading each pixel of the FLCD with its multi-bit pixel data from the external frame buffer memory. Typically, each pixel in the FLCD has a single bit storage element. Therefore, the external frame buffer memory must supply a series of single bits of pixel data to the pixels in order to display a particular color with a particular grayscale at each pixel. The number of bits required for each pixel of FLCD to produce a desired color at a desired intensity may be 24 or more bits (e.g., three colors with eight bits of grayscale per color).

Depending upon the bits of the pixel data, light from the illuminator is either reflected to or deflected from the viewing optics. The pixels in the FLCD act as time-modulated micro mirrors in concert with the illuminator to produce the color image, which is determined by the values of the bits of pixel data. Quality of the color image is determined by the density of the pixels, the number of color-related bits within the pixel data to each pixel, and the data transfer rate of the pixel data to the pixels.

To display a high quality color image on the FLCD having the single bit storage elements, a high bandwidth data link from the external frame buffer memory to the individual pixels is required. However, high bandwidth data links are expensive, potentially noisy, and require a great amount of power.

U.S. Pat. No. 4,432,610 to Kobayashi et al. (hereinafter Kobayashi) entitled "Liquid Crystal Display Device," describes LCDs with various storage elements in the pixels. All of the storage elements described in Kobayashi are single-bit storage elements.

A concern with single-bit storage elements in an LCD is the need to continually supply bits of pixel data at a high data transfer rate to develop a high resolution image on the LCD. Unless a sufficiently high data transfer rate is achieved, there will be limitations on the size of the LCD array, the display frame rate, and/or the number of bits of pixel data that may be transferred per frame. These physical limits affect the quality of the display image.

Another LCD with single-bit storage elements is described in U.S. Pat. No. 5,471,225 to Parks entitled "Liquid Crystal Display with Integrated Frame Buffer." The single-bit storage elements in the LCD of Parks are static random access memory (SRAM) cells comprised of three transistors and two resistors. The SRAM cells allow the LCD to display an image for an indefinite amount of time without refreshing. However, the data transfer rate concern identified above for the LCDs of Kobayashi exists for the LCD of Parks. U.S. Pat. No. 5,627,557 to Yamaguchi et al. (hereinafter Yamaguchi) entitled "Display Devices," describes an improved pixel for an LCD. The pixel includes circuitry for providing an inverse of the pixel data for DC balancing by using two dynamic sample-and-hold capacitors in addition to a single storage element. The DC balancing circuitry reduces the required data transfer rate from an external frame buffer memory to the pixels in the LCD by a factor of 2.

In another embodiment, Yamaguchi describes a pixel with the ability to display a first bit of pixel data while writing a second bit of pixel data. Each pixel in this embodiment functions as a pixel with a two-bit storage element, further reducing the data transfer rate. However, the LCDs of Yamaguchi still require a relatively high data transfer rate, and potentially impose limitations relating to LCD size, frame rate, and color-related bits per pixel, as described above.

The high bandwidth requirement exists even when the device driving the LCD is in a "static" display mode. For example, a laptop computer for which an LCD displays a static (i.e., continuous) image of a portion of a word processing document requires a high data transfer rate to repeatedly supply identical pixel data to the LCD. A data transfer rate in the range of 100 Mega bits-per-second (bps) to more than 2 Giga bps may be required to maintain the image of the document.

What is needed is an LCD having pixels with storage elements that relax the data rate and bandwidth requirements typically imposed by operation of an LCD device.

SUMMARY OF THE INVENTION

A display device and a method of driving individual pixels within a display area of the device include integrating memory cells within each pixel. Preferably, the memory cells allow read operations of pixel data to be isolated from write operations. This is achieved by providing dual port memory cells. Also in the preferred embodiment, the number (M) of dual port memory cells within each pixel is equal to the number of bits of pixel data directed to the pixel per frame. That is, if a frame of pixel data includes eighteen bits of color and grayscale information, each pixel preferably includes an array of eighteen dual ported memory cells.

Each dual ported memory cell may be a dynamic random access memory (DRAM) cell formed by a write port, a storage element, and a series gated read port. The dual ported memory cell can be formed by a series connection of four devices, such as four transistors. Alternatively, the dual ported memory cell can be formed by a series connection of three devices and a capacitor, such as three transistors and a planar, a stacked, or a trench capacitor. In the four-transistor embodiment, one transistor functions as a capacitor to store a charge that is indicative of the value of a bit of the pixel data.

On one side of the storage device is a write access device that is manipulated during a write operation to connect the storage device to a write bit line from which the pixel data is received. Connected to the same storage device are two series connected read devices that are separately controlled to read data to a local read bit line. The series connected read devices function as a local read decoder. The bit of pixel data within the storage device is read only when both of the read devices are "on." One read device may be controlled by a read_ color signal, while the other read device may be controlled by a read_ grayscale signal. Because the reading operation of a particular memory cell is executed only when the correct combination of signals is present at that memory, a time sequential reading of the entire cell array can occur. Moreover, the time sequential reading of a particular memory array can be identically and simultaneously implemented at all of the memory arrays within the display area of the device.

The display device is typically a liquid crystal device, and preferably a ferroelectric liquid crystal device (FLCD). However, the array of dual port memory cells may be utilized in other display devices in which optical properties of individual pixels are determined by receiving multi-bit pixel data. In addition to the array of memory cells, each pixel includes a sense amplifier, a DC balance circuit and a driver circuit.

In operation, frames of pixel data are conducted to the pixels within the display area of the device. Each frame includes multi-bit pixel data for each pixel within the display area. That is, pixel-related bits of data are directed to each memory array. At each memory array, the pixel-related bits are written into different memory cells. The composite memory arrays have the capacity to store the entire frame.

The stored pixel-related bits are read in a selected sequence that is preferably followed at each of the pixels within the display area. The bits are accessed during the read operation and are directed to the liquid crystal along a read bit path that is isolated from the write bit path used during the write operation. Thus, the read operations may be implemented independently from the write operations. One advantage of the invention is that the rate of writing pixel data to the pixels may be selected to be compatible with a host system, while the rate of reading pixel data may be selected to maximize image quality.

Another advantage of the invention is that all of the bits required for a particular image can be stored into the pixels. The capacity to store the entire frame within the pixels eliminates the need for an external frame buffer and relaxes the data rate and bandwidth requirements for providing pixel data to the display device.

DETAILED DESCRIPTION

Figure 1:
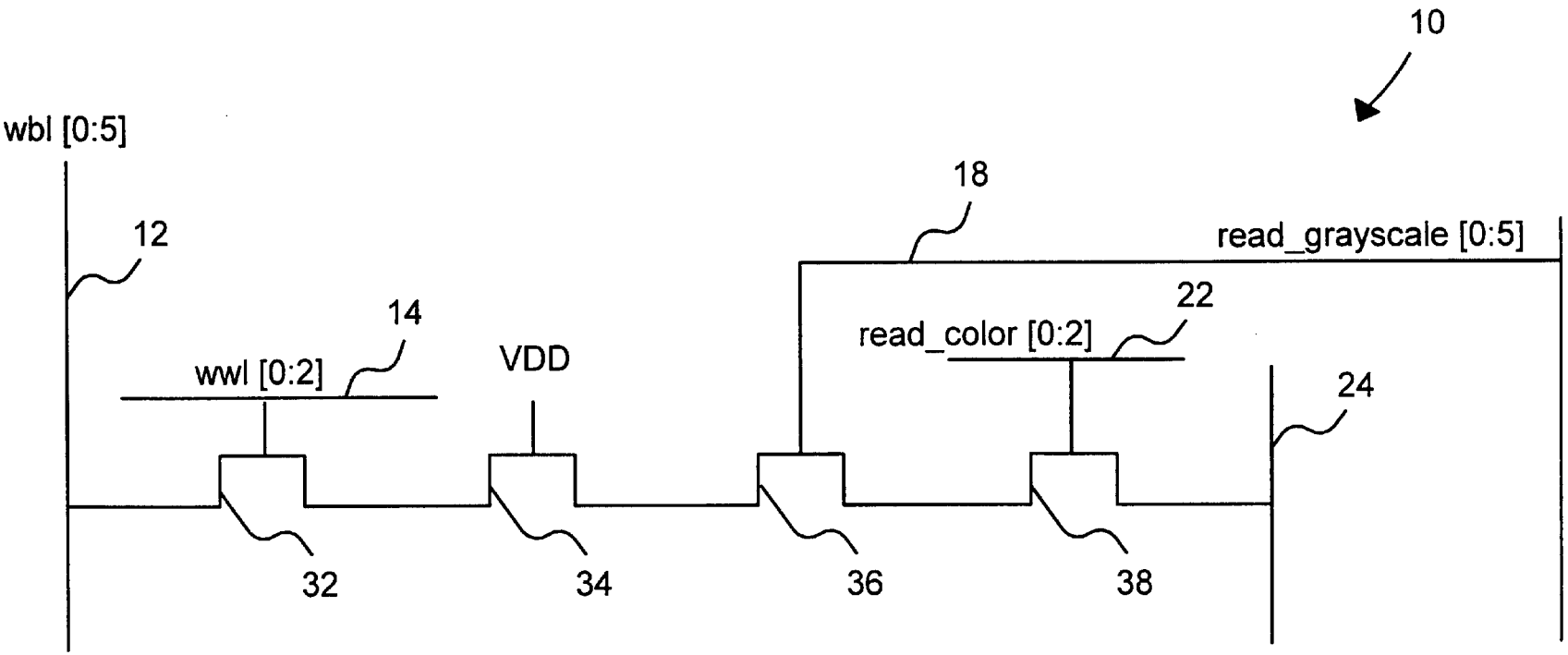
FIG. 1 is a schematic diagram of a dual port dynamic random access memory cell in accordance with the invention.

With reference to FIG. 1, a dual port dynamic random access memory (DRAM) cell 10 for use in LCD applications is shown connected to a write bit line 12 and a read bit line 24. A write transistor 32, a storage transistor 34, a vertical read transistor 36, and a horizontal read transistor 38 have main conduction paths that are connected in series, providing a conduction path from the write bit line 12 to the read bit line 24. The transistors 32, 34, 36 and 38 are shown as metal-oxide semiconductor (MOS) transistors.

A gate of the write transistor 32 is connected to a write word line 14, while a gate of the storage transistor 34 is connected to a supply voltage (VDD). Gates of the vertical read transistor 36 and the horizontal read transistor 38 are connected to a vertical read line 18 and a horizontal read line 22, respectively.

In order to write a bit of pixel data into the dual port DRAM cell 10, the storage transistor 34 is initially charged up to a set voltage by applying VDD, for example 5 volts, to the gate of the storage transistor 34. The storage transistor 34 essentially functions as a capacitor. The actual writing of the data is accomplished by addressing the write word line (wwl) 14, turning on the write transistor 32, and receiving the bit of pixel data from the write bit line (wbl) 12 while the conduction path to the read bit line (rbl) 24 is blocked by either the transistor 36 or the transistor 38, either of which is turned "off" by a control signal to the vertical read line 18 or the horizontal read line 22, respectively. Depending on whether the bit is a "0" or "1," the voltage stored in the storage transistor 34 will charge to one of two levels.

The reading of the data involves addressing both the vertical read grayscale line 18 and the horizontal read color line 22. Simultaneously addressing the read lines 18 and 22 turns on the vertical transistor 36 and the horizontal read transistor 38, providing a conduction path from the storage transistor 34 to the read bit line (rbl) 24 while the conduction path to the write bit line (wbl) 12 is blocked by the transistor 32 which is turned "off" by a control signal to the write word line.

There is an array of dual port DRAM cells 10 in each pixel of an LCD. In the preferred embodiment, the number of such cells is equal to the number of bits in each segment of pixel data of a frame. For example, in an application in which a frame of pixel data includes eighteen bits per pixel (e.g., three colors and six bits of grayscale per color), each pixel of the LCD preferably has eighteen dual port DRAM cells. Preferably, the number (M) of bits in the pixel data that is directed to a particular pixel per frame is equal to at least twelve, so that there are at least twelve DRAM cells per array. The series gating of the two read transistors 36 and 38 enables the selection of a particular dual port DRAM cell in a pixel. The ability to select a particular dual port DRAM cell is equivalent to the function of a conventional external decoder. Thus, an LCD with dual port DRAM cells does not need a separate decoder.

The physical design of the dual port DRAM cell permits writing of a word many bits wide into a row of dual port DRAM cells. This physical design also enables reading operations to take place while a write word line is accessed for a single writing operation. Thus, the reading operation is independent from the writing operations. The independent writing and reading feature enables the LCD with dual port DRAM cells to have a slow data input rate to match a variety of host systems, as well as a fast display rate to minimize flickers and display artifacts.

Figure 2:
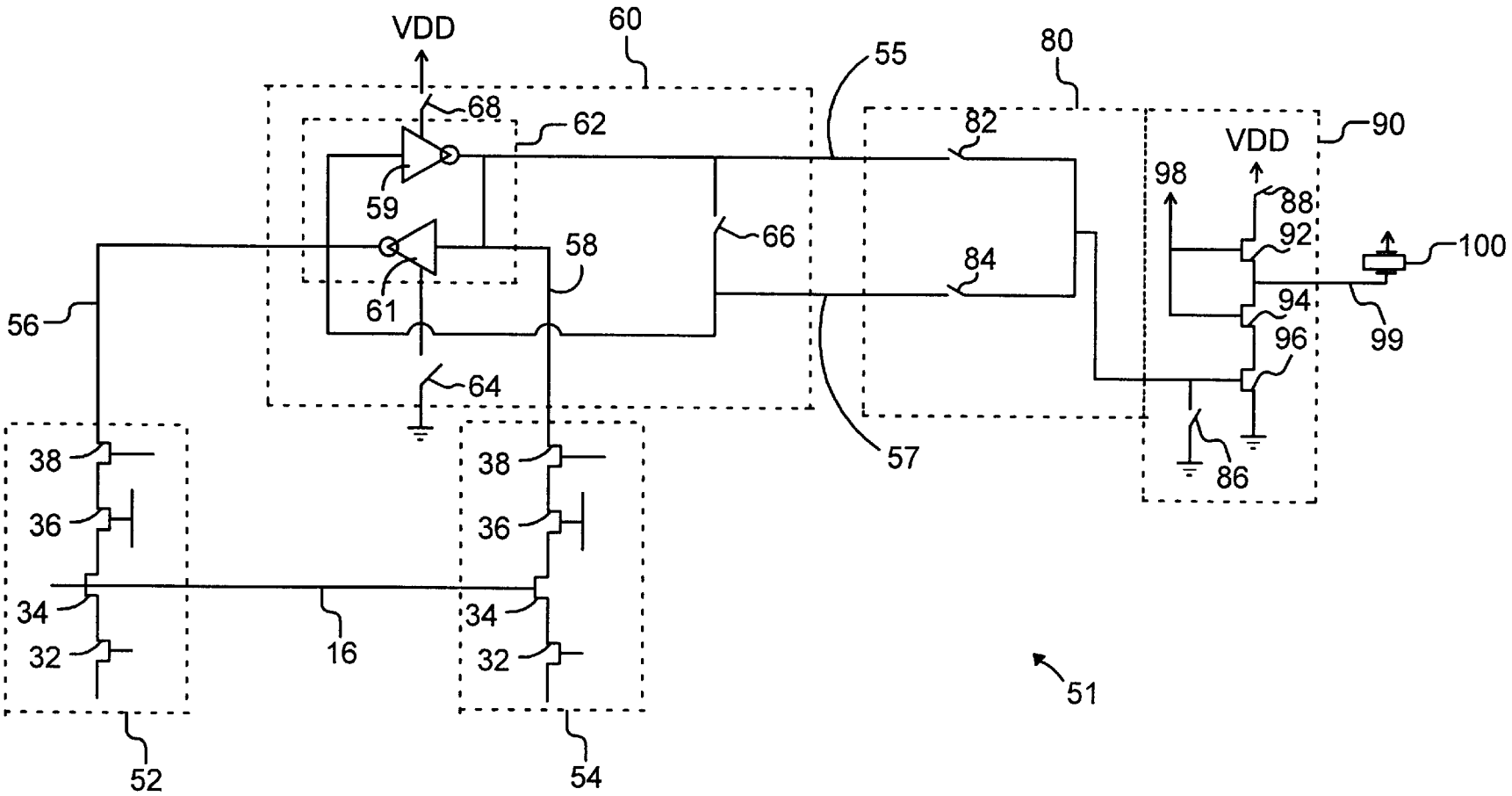
FIG. 2 is a schematic diagram of an 18-bit register pixel with a ½V sensing scheme in accordance with the invention.

Turning to FIG. 2, a schematic diagram of an 18-bit register pixel 51 with a ½V sensing scheme is shown. The 18-bit register pixel contains eighteen dual port DRAM cells of the type described with reference to FIG. 1. The DRAM cells are divided into a left array and a right array. The left array contains nine dual port DRAM cells, but is represented in FIG. 2 by a single dual port DRAM cell 52. The right array also contains nine dual port DRAM cells, but is represented by a single dual port DRAM cell 54. The left array is connected to a left read bit line 56, while the right array is connected to a right read bit line 58. A supply voltage line 16 (e.g., VDD) is connected to both dual port DRAM cells 52 and 54.

The read and write operations of the dual port DRAM cells 52 and 54 are identical to the operations of the dual port DRAM cell 10 in FIG. 1. If the dual port DRAM cell 52 is read, the data will appear at the left read bit line 56. Similarly, if the dual port DRAM cell 54 is read, the data will appear at the right read bit line 58. The read bit lines 56 and 58 are connected to sense amplifier circuitry 60.

Figure 6:
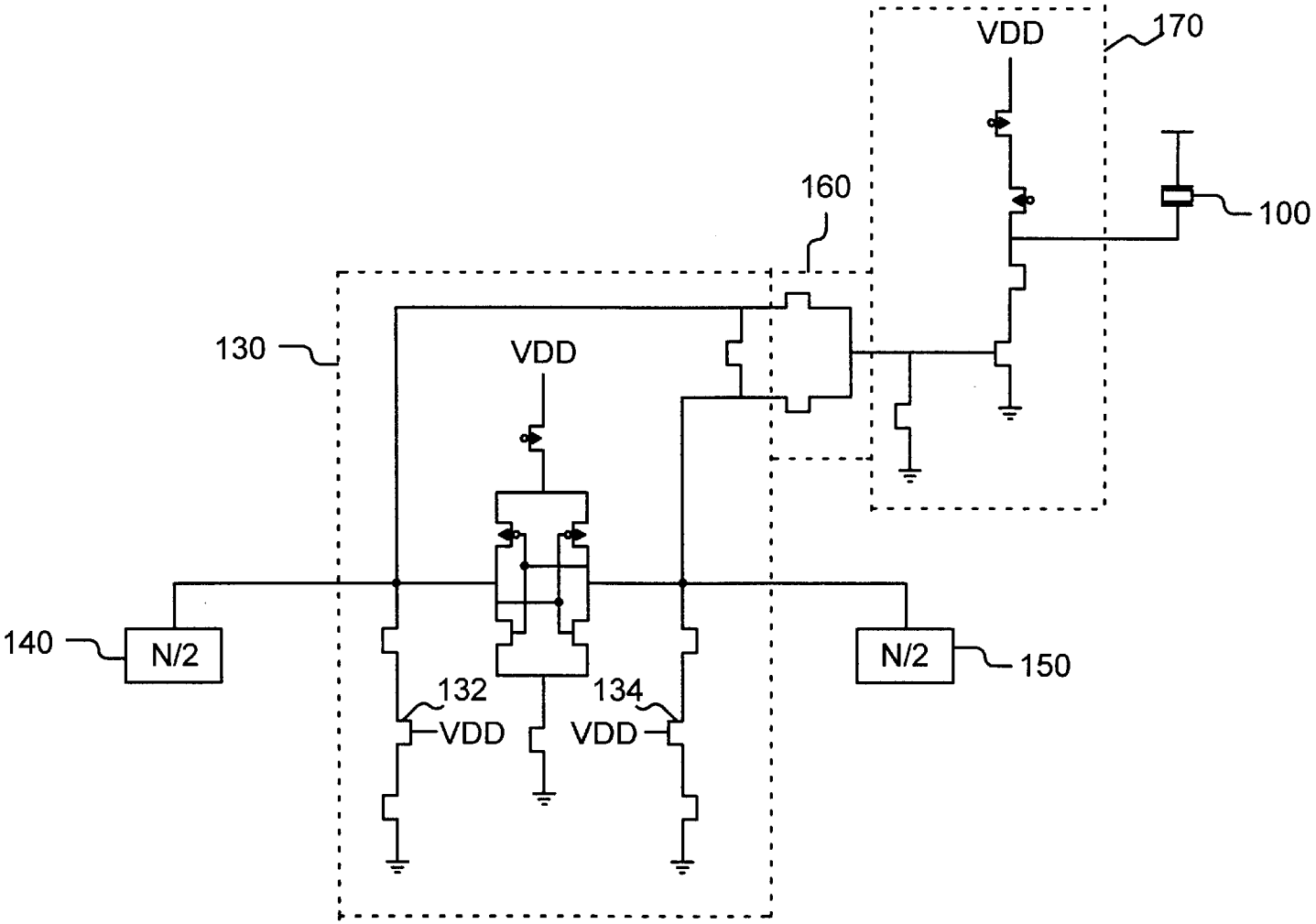
FIG. 6 is a schematic diagram of a 24-bit register pixel with a ½C sensing scheme in accordance with the invention.

The sense amplifier circuitry 60 includes a sense amplifier 62 and three electrical switches 64, 66 and 68. Although the sense amplifier circuitry 60 utilizes a ½V scheme, any conventional sense amplifier scheme, such as a ½C scheme or a form of asymmetric sense amplifier, could be implemented. One output line 57 of the sense amplifier 62 is connected to the left read bit line 56, and the other output line 55 is connected to the right read bit line 58. The sense amplifier 62 is a cross coupled latch gated sense amplifier having two inverters 59 and 61 and may comprise two P-channel MOS transistors located on the upper portion of the sense amplifier 62 and two N-channel MOS transistors located on the lower portion of the sense amplifier 62 (as shown in FIG. 6). One of the P-channel transistors and one of the N-channel MOS transistors are connected in series from the switch 68 to the switch 64. The other two P-channel and N-channel MOS transistors are also connected in series from the switch 68 to the switch 64, so that parallel conduction paths are formed between the switches 64 and 68. The switch 64 provides a path from one end of the parallel conduction paths to ground, while the switch 68 connects the opposite end to VDD. The switch 66, when closed, electrically links the two output lines 55 and 57 of the sense amplifier 62.

The sense amplifier circuitry 60 is a dynamic circuit and requires a precise timing sequence. During an initial precharge state, the switch 66 is turned on, connecting the output lines 55 and 57 of the sense amplifier 62 to each other. The connection equalizes both sides of the sense amplifier 62 to approximately one-half of VDD, or 2.5 volts when the VDD is 5.0 volts. Then, the switch 66 is turned off, disconnecting the output lines of the sense amplifier 62. The sense amplifier 62 is now ready to receive a bit of pixel data.

At this point, one of the eighteen dual port DRAM cells of the register pixel 51 is selected to be read. The selected dual port DRAM cell could be located on the left array or the right array, such as cell 52 or cell 54. Depending upon the location and the bit of pixel data stored, the selected dual port DRAM cell will tend to pull the left read bit line 56 or the right read bit line 58 either low or high. Then, the switch 68 is closed, connecting the two P-channel MOS transistors of the sense amplifier 62 with VDD. After a short time delay, the switch 64 is closed, providing a conduction path from the two N-channel MOS transistors of the sense amplifier 62 to ground.

The imbalance between the two output lines 55 and 57 of the sense amplifier 62 caused by the bit of image data is amplified by the sense amplifier 62 to a signal swing. The swing of the sense amplifier 62 drives one output line of the sense amplifier to a high voltage (VDD) and the other output line to a low voltage (ground) in the direction of the memory cell that was read. The swing also causes the memory cell that was read to be refreshed or restored.

The swing of the sense amplifier 62 is also used to drive and refresh liquid crystal 100 of a particular pixel of the pixel array that forms the LCD. Depending upon the bit of pixel data that was sensed, one of the voltages on the output lines 55 and 57 is a true signal, representing the sensed bit of pixel data, and the other voltage is an inverted signal. The true signal is used to drive the liquid crystal 100, while the inverted signal is subsequently used to DC balance or refresh the liquid crystal 100.

The sense amplifier circuitry 60 is connected to DC balancing circuitry 80, which consists of two switches 82 and 84. During a display cycle in which the true signal is on the output line 55, the switch 82 is closed to allow the true signal to conduct to a liquid crystal driver 90. On the other hand, the switch 84 is closed during a subsequent DC balance cycle to allow the inverted signal to conduct through the DC balancing circuitry to reset the liquid crystal 100. Providing an inverted signal or DC balancing is required of most LCDs and is known in the art.

In the preferred embodiment, the liquid crystal 100 is a ferroelectric liquid crystal or a polar liquid crystal. The ferroelectric liquid crystal is favored over a twisted nematic liquid crystal, because the ferroelectric liquid crystal changes its state more quickly, allowing a better display of motion.

Also shown in FIG. 2 is the liquid crystal driver 90 which is connected between the DC balancing circuitry 80 and the liquid crystal 100. The liquid crystal driver 90 is a conventional circuit and may consist of two switches 86 and 88 and three MOS transistors 92, 94 and 96. The VDD switch 88 and the three transistors 92, 94 and 96 are connected in series from VDD to ground. Gates of transistors 92 and 94 are coupled and connected to a voltage source 98. For example, the voltage source 98 may provide 2.5 volts to the gates of transistors 92 and 94. Connected between the transistors 92 and 94 is an output terminal 99 which leads to the liquid crystal 100.

A gate of transistor 96 provides the connection from the liquid crystal driver 90 to the DC balancing circuitry 80. Also connected to the gate of transistor 96 is the ground switch 86, which provides a conduction path from the gate of transistor 96 to ground.

In order for the liquid crystal driver 90 to drive the liquid crystal 100, the switches 86 and 88 are closed during a driver precharge stage. The closing of switch 86 turns off the transistor 96 and drives the voltage low at the gate of transistor 96. The closing of switch 88 connects VDD to the output terminal 99, driving the voltage high on the output terminal 99. Once the output terminal 99 is charged high, the switches 86 and 88 are opened.

After a bit is read from one of the eighteen DRAM cells that include cells 52 and 54, either the true signal or the inverted signal is received from the DC balancing circuitry 80. Since the gate of transistor 96 was already precharged to a low voltage, if the received signal is low, the transistor 96 will remain in the "off" state. However, if the received signal is high, the voltage at the gate of transistor 96 will be pulled high, turning on the transistor 96. The activation of the transistor 96 provides a conduction path from the output terminal 99 to ground, which drives the voltage low on the output terminal 99. The voltage drop on the output terminal 99 drives the liquid crystal 100 to display the bit of pixel data or to refresh the liquid crystal 100.

In the preferred embodiment, all of the switches in FIG. 2 are semiconductor (MOS) transistors which are fabricated using a CMOS process. However, other electrical devices having "on" and "off" states could be utilized.

Figure 3:
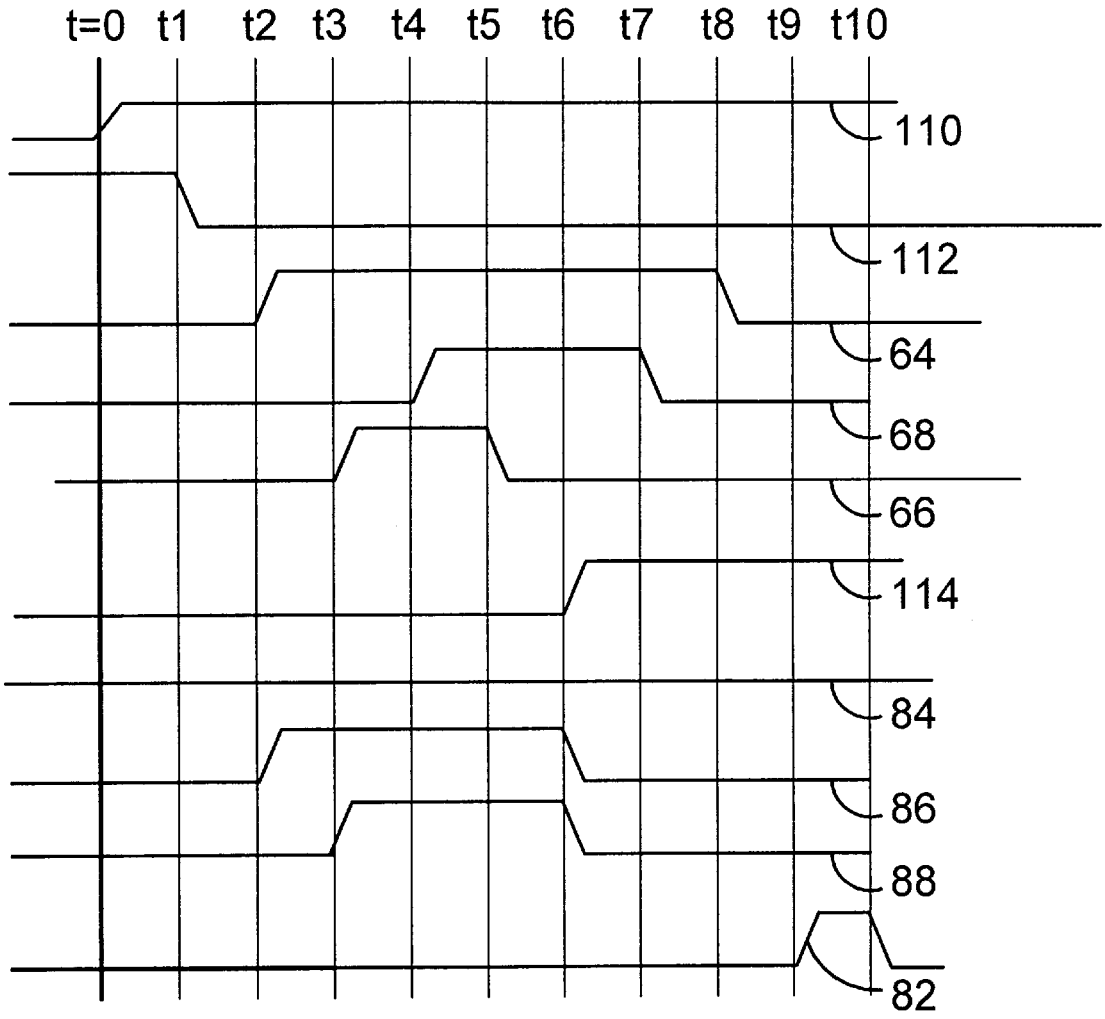
FIG. 3 is a refresh/read timing sequence for the 18-bit register pixel in accordance with the invention.

FIG. 3 shows a refresh/read timing sequence for the 18-bit register pixel 51 of FIG. 2. The reference numerals in FIG. 2 are used in FIG. 3 when referring to the same components. At t=0, a refresh clock 110 goes high and a dual port DRAM cell 112 that was read in a previous cycle is refreshed. At t=t1, refreshing the previous dual port DRAM cell 112 is completed. At t=t2, the switch 64 is opened, turning off the connection from the sense amplifier 62 to ground. In addition, the switch 86 is closed, connecting the gate of transistor 96 to ground. The effect of closing the switch 86 is to precharge the gate of transistor 96 to low. At t=t3, the switch 66 is closed, equalizing the two output lines 55 and 57 of the sense amplifier 62. The switch 88 is also closed at this time, precharging the output terminal 99 to high. At t=t4, the switch 68 is opened, turning off the connection from VDD to the sense amplifier 62. At t=t5, the switch 66 is opened to prepare for receiving a new bit of pixel data.

The read operation of the 18-bit register pixel 51 begins at t=t6. At this time, a dual port DRAM cell 114 is accessed. The switches 86 and 88 are opened, terminating the pre-charge stage for the liquid crystal driver 90. Upon accessing the DRAM cell 114, the imbalance of the sense amplifier 62 induced by the received bit of data causes the sense amplifier 62 to swing one of the output lines 55 and 57 of the sense amplifier 62 to VDD and the other output line to ground, depending on the value of the bit after the switches 64 and 68 are closed. At t=t7, the switch 68 is closed, turning on the connection from VDD to the sense amplifier 62. At t=t8, the switch 64 is closed, turning on the connection from the sense amplifier 62 to ground. At t=t9, the switch 82 is closed, connecting the sense amplifier 62 to the liquid crystal driver 90. Depending upon the bit of image data that was read from the dual port DRAM cell 114, the liquid crystal driver 90 either drives the output terminal 99 low, turning on the liquid crystal 100, or does not change the output terminal 99, leaving the liquid crystal 100 in the pre-charge high state in which the liquid crystal 100 was turned "off." Lastly, at t=t10 the switch 82 is opened, disconnecting the sense amplifier 62 from the liquid crystal driver 90, terminating the read operation.

Figure 4:
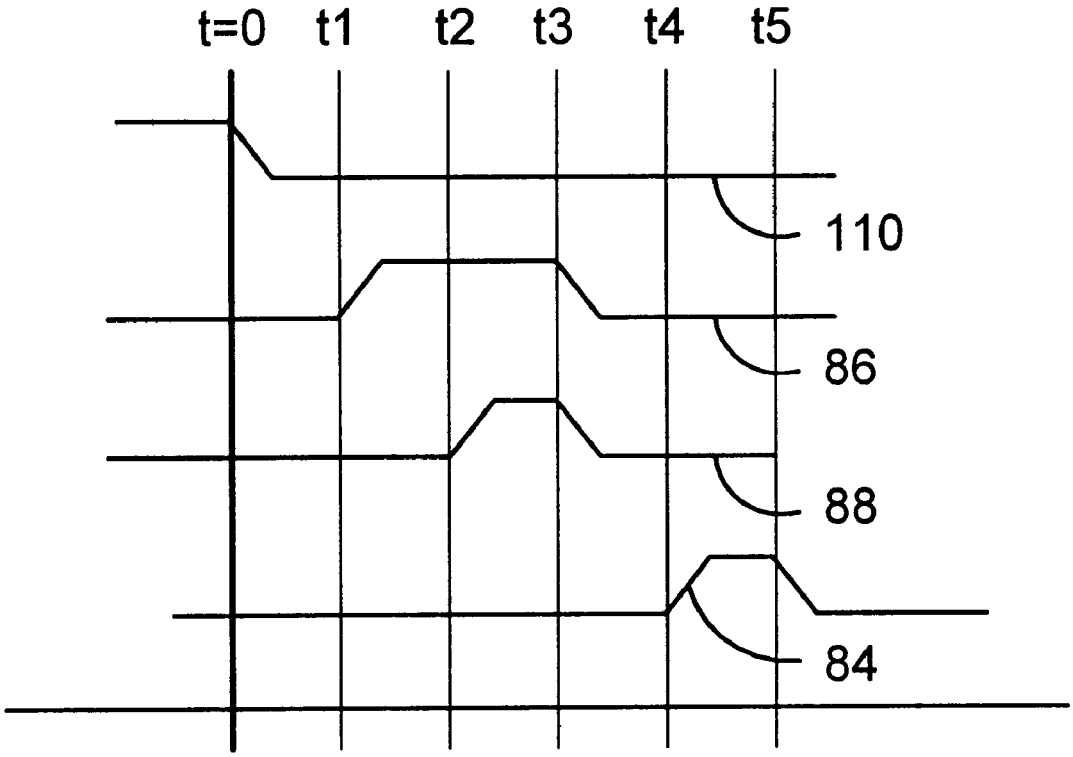
FIG. 4 is a DC balance timing sequence for the 18-bit register pixel in accordance with the invention.

In FIG. 4, a DC balance timing sequence is illustrated. Again, the reference numerals from FIG. 2 as well as from FIG. 3 are used when applicable. The operation of the 18-bit register pixel 51 with respect to the DC balance will be described with reference to FIGS. 2 and 4. At t=0, the refresh clock 110 is turned off. At t=t1, the switch 86 is closed, connecting the gate of transistor 96 to ground. Closing the switch 86 has the effect of precharging the gate of transistor 96 to low. At t=t2, the switch 88 is closed, charging the output terminal 99 to high. At t=t3, both switches 86 and 88 are opened, terminating the precharge stage of the liquid crystal driver 90. At t=t4, the switch 84 is closed, connecting the sense amplifier 62 to the liquid crystal driver 90. Depending upon the bit of pixel data that was previously read, the liquid crystal driver 90 sets the output terminal 99 low, turning "on" the liquid crystal 100, if the previous state of the liquid crystal 100 was off during the read timing sequence shown in FIG. 3, or does not change node 99, leaving the liquid crystal 100 in the pre-charge high state. Then at t=t5, the switch 84 is opened, isolating the sense amplifier 62 from the liquid crystal driver 90 and terminating the DC balance.

Figure 5:
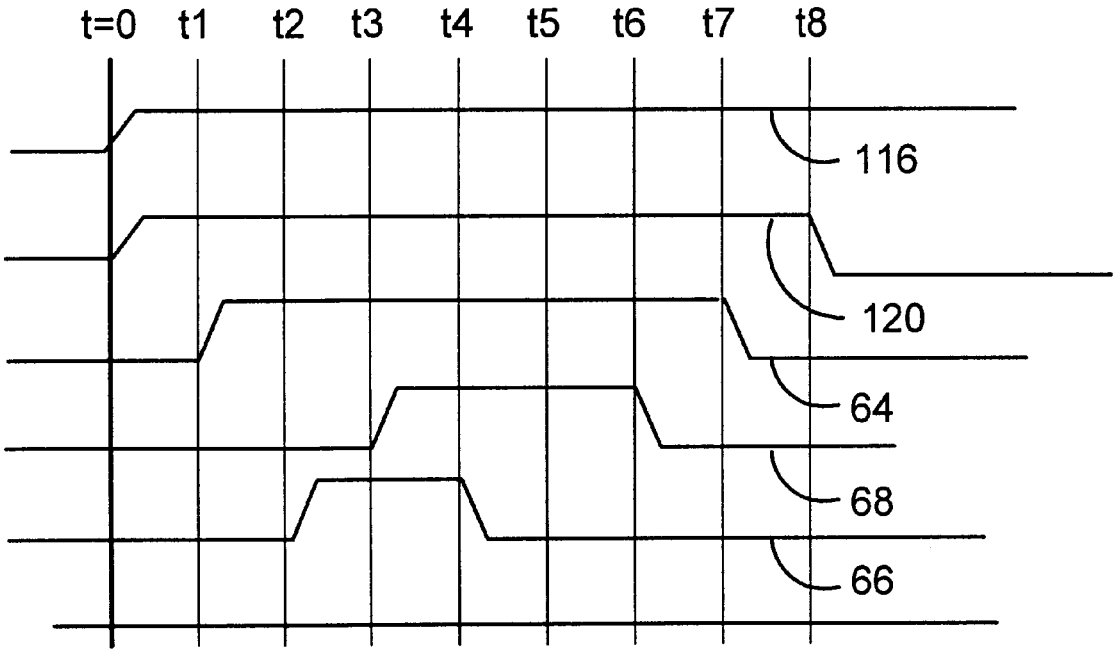
FIG. 5 is a write/refresh timing sequence for the 18-bit register pixel in accordance with the invention.

Turning to FIG. 5, a write/refresh timing sequence is shown. The write/refresh timing sequence is necessary to write new data from the write bit line 12 to the sense amp 62 through the pixel addressed by an active write word line 116. Again, the reference numerals from FIG. 2 as well as from FIG. 3 are used when applicable. The operation of the 18-bit register pixel 51 with respect to the write/refresh will be described with reference to FIGS. 2 and 5. At t=0, the write/refresh clock 120 is turned on and the single write word line (wwl) 116 is accessed. At t=t1, the switch 64 is opened, turning off the connection from the sense amplifier 62 to ground. At t=t2, the switch 66 is closed, equalizing the output lines 55 and 57 of the sense amplifier 62. At t=t3, the switch 68 is opened, turning off the connection from VDD to the sense amplifier 62. At t=t4, the switch 66 is opened to prepare for write/refresh operation. At t=t6, the switch 68 is closed turning on the connection from VDD to the sense amplifier 62. At t=t7, the switch 64 is closed, turning on the connection from the sense amplifier 62 to ground. At this time, a bit of pixel data is written or refreshed onto a single dual port DRAM cell. At t=t8, the write/refresh clock 120 is turned off.

Referring again to FIG. 1, because write bit line 12 is isolated from the read bit line 24, the read operations of the dual port memory cell 10 may occur at a frequency greater than the write operations. This has the advantage of allowing the write operations to be conducted at a rate that is compatible with a relatively slow host system, while the frequency of the read operations is selected to minimize flicker and display artifacts. Ideally, the frequency of write operations is reduced to zero when the display system electronically recognizes that consecutive frames of pixel data are identical for a significant period of time, such as when a laptop computer displays a portion of a word processing document for review by the user of the computer.

As shown in FIG. 1, the dual port memory cell 10 is comprised of the write access transistor 32 that is controlled by the write word line 14 to connect the write bit line 12 to a storage device, such as a large gate area transistor 34 with its gate connected to a fixed voltage (VDD) to invert the surface of the silicon and to function as a storage capacitor. The dual port memory cell also includes two series-connected read transistors 36 and 38, with the first read transistor being controlled by a read_grayscale signal along line 18 and the second transistor controlled by a read_color signal along line 22. The storage device 34 is connected to the read bit line 24 only when both of the read transistors 36 and 38 are activated. The physical design of the memory cell allows for writing a word that is many bits wide (e.g., six or eight bits) into a row of memory cells with one write word line access as a write operation, while independent read operations occur. Each independent read operation occurs as a unique combination of read_grayscale and read_color signals to read a single bit within a particular pixel in the array of pixels for the display device. However, the same combination of read_grayscale and read_color signals reads the corresponding bit from every pixel in the pixel array. If the number of pixels to be read is equal to M, the preferred embodiment is one in which the number of dual port memory cells is equal to M and the read operations of cells follow the same sequence for all of the pixels. The process of sequentially reading the cells in a particular array provides the functions of sampling and refreshing the stored data on the dynamic storage nodes and supplies display data to the driver circuitry for the time sequential construction of the image that is displayed.

The size of the pixels and the arrangement of pixels is not critical to the invention. Fabricating memory cell arrays as described above may be implemented into a VGA array (i.e., 640×480 pixel array) in a 0.35 $\mu$m CMOS process, or even a QGA array (i.e., 1280×960 pixel array) in a 0.18 $\mu$m CMOS process.

FIG. 6 is a schematic diagram of a 24-bit register pixel (i.e., N=24), with a ½C sensing scheme. The 24-bit register pixel is very similar to the 18-bit register pixel 51 of FIG. 2. There are only two major differences. Apparent from the name, the 24-bit register pixel has six additional dual port DRAM cells. Since the 24-bit register pixel also has a left memory array 140 and a right memory array 150, the six additional cells are distributed equally between the memory arrays 140 and 150. Therefore, the memory arrays 140 and 150 each contain twelve dual port DRAM cells. The other major difference between the 24-bit and the 18-bit register pixel is the sense amplifier scheme. The sense amplifier circuitry 60 (FIG. 2) in the 18-bit register pixel utilizes a ½V sensing scheme. The 24-bit register pixel shown in FIG. 6 utilizes a ½C sensing scheme for the sense amplifier circuitry 130. As stated above, the type of sensing scheme utilized is not crucial to the invention.

All of the switches described with reference to FIG. 2 are shown in FIG. 6 as transistors and the sense amplifier within the sense amplifier circuitry 130 is illustrated in detail, also with transistors. However, these transistors function in the same manner as the corresponding components described in reference to the 18-bit register pixel. Thus, the difference is only in form and not of content.

Identical to the 18-bit register pixel, the left memory array 140 is connected to one side of the sense amplifier circuitry 130 and the right memory array 140 is connected to the other side. The sense amplifier circuitry 130 is connected to DC balance circuitry 160 which is identical to the DC balance circuitry 80. A liquid crystal driver 170 is connected to the balance circuitry 160. Again, the liquid crystal driver 170 is identical to the liquid crystal driver 90 in FIG. 2. The liquid crystal driver is connected to the liquid crystal 100.

The 24-bit register pixel operates in a very similar manner to the 18-bit register pixel. The only difference is in the operation of the sense amplifier circuitry 130 compared to the sense amplifier circuitry 60 in FIG. 2. The sense amplifier circuitry 130 utilizes a ½C scheme, using two dummy memory cells 132 and 134 instead of the ½V scheme of the sense amplifier circuitry 60. The ½C scheme for a sense amplifier is known in the art. The difference in scheme, however, does not affect the function of the sense amplifier circuitry 130. The sense amplifier circuitry 130 also detects an imbalance caused by a bit of pixel data when a particular dual port DRAM cell is read and swings one output of the sense amplifier to high voltage and the other side to low voltage. The high and low signal is sent to the liquid crystal driver 170 through the DC balance circuitry 160 to drive the liquid crystal 100 in the same manner as described above for the 18-bit register pixel 51.

Although only the 18-bit register pixel and the 24-bit register pixel are describe herein, other pixel designs using the dual port DRAM cells and other components of the 18-bit and the 24-bit register pixels are contemplated. The number of dual port DRAM cells that could be fabricated on a single pixel is only limited by the chip manufacturing technology. Therefore, additional dual port DRAM cells can be placed in a single pixel to yield a variety of register pixels such as 36-bit, 48-bit and 64-bit register pixels.

What is claimed is:

1. A display device having a display area formed of an array of closely spaced pixels for which optical properties of the individual pixels are determined by receiving multi-bit pixel data, each pixel comprising:

means for switching between at least two optical states in response to conditions of electrical fields that are determined by said pixel data; and at least one dual port memory cell having circuitry for storing a bit of said pixel data, said cell having a write bit line connected to receive said bit of said pixel data and a read bit line, said write and read bit lines being isolated such that said at least one dual port memory cell is independently accessible with respect to read and write operations, said read bit line being connected to said means for switching, each said dual port memory cell having first and second independently addressable read lines and being selectively accessible to transfer a stored bit to said means for switching via said read bit line when both of said first and second read lines of said dual port memory cell are addressed.

2. The display device of claim 1 wherein said means for switching includes liquid crystal.

3. The display device of claim 1 wherein for each pixel of said display area, the number of said dual port memory cells is equal to the number of bits within said multi-bit pixel data, said bits being indicative of color and grayscale information.

4. The display device of claim 3 wherein each said dual port memory cell is dedicated to a particular bit of said multi-bit pixel data.

5. The display device of claim 1 wherein said circuitry of said dual port memory cell includes a storage transistor and a series connection of write and read transistors, said storage transistor being connected to store said bit of pixel data, said write and read transistors being independently manipulated to selectively transfer said bit from said write bit line to said storage transistor and to selectively transfer said bit from said storage transistor to said read bit line.

6. The display device of claim 5 wherein said read transistors include first and second read transistors connected in series with said storage transistor on a side of said storage transistor opposite to said write transistor, thereby forming a conduction path of at least four transistors, said write and read bit lines being connected on opposite ends of said conduction path.

7. The display device of claim 1 wherein said means for switching includes liquid crystal and circuitry for driving said liquid crystal, said circuitry of said means for switching and said circuitry of each of said at least one dual port memory cell being integrated into said pixel.

8. A liquid crystal display comprising:

an input of multi-bit pixel data having at least three bits indicative of color and grayscale; and an array of pixels, each pixel including liquid crystal and a cell array of at least three memory cells, said arrays being connected to said input, said memory cells within each cell array being dedicated on a one-to-one basis to storing a selected one of said at least three bits, said memory cells within each cell array being individually addressable to sequentially connect said memory cells to drive said liquid crystal, wherein each said memory cell is a dual port memory cell having at least two independently addressable read lines, each said dual port memory cell being configured to be selectively accessible to transfer a stored bit to drive said liquid crystal when said independently addressable read lines of said dual port memory cell are simultaneously addressed, each said dual port memory cell having isolated write-in and read-out bit lines such that a write operation may be performed separately from a read operation.

9. The display of claim 8 wherein each dual port memory cell is a DRAM cell having a bit storage device between at least one write access transistor and at least one read access transistor.

10. A method of driving liquid crystal in an array of pixels of a display device comprising steps of:

conducting a frame of multi-bit pixel data to memory arrays integrated into said pixels, including directing at least three pixel-related bits of pixel data to each of said memory arrays;

at each of said memory arrays, writing said at least three pixel-related bits into said memory array to which said pixel-related bits are directed, said memory arrays having capacity to store said frame;

selectively accessing cells of said memory arrays such that, within each pixel, said pixel-related bits of said pixel data are read in a selected sequence from said memory array of said each pixel, said selective accessing occurring upon simultaneously addressing at least two independently addressable read lines associated with each said cell of said memory array; and applying electrical fields to said liquid crystal within individual pixels based upon said sequential reading of said pixel-related bits for said individual pixels.

11. The method of claim 10 wherein said step of selectively accessing said cells to read said pixel-related bits is executed at a rate greater than said step of writing said plurality of pixel-related bits.

12. The method of claim 10 wherein said step of selectively accessing said cells includes isolating a read bit path from a write bit path that is used in said step of writing.

13. The method of claim 10 wherein said step of conducting said frame to said memory array is executed in the absence of a frame buffer.

14. A display device having a display area formed of an array of closely spaced pixels for which optical properties of the individual pixels are determined by receiving multi-bit pixel data, each pixel comprising:

means for switching between at least two optical states in response to conditions of electrical fields that are determined by said pixel data; and at least twelve dual port memory cells, each dual port memory cell being a dynamic random access memory (DRAM) cell having circuitry for storing a bit of said pixel data, each said cell having a write bit line connected to receive said bit of said pixel data and a read bit line, said write and read bit lines being isolated such that said at least one dual port memory cell is independently accessible with respect to read and write operations, said read bit line being connected to said means for switching to selectively apply said bit of pixel data to said means for switching.

15. A liquid crystal display comprising:

an input of multi-bit pixel data having M bits indicative of color and grayscale; and an array of pixels, each pixel including liquid crystal and a cell array of at least twelve memory cells, each memory cell being a DRAM dual port memory cell having isolated write-in and read-out bit lines and a bit storage device, between at least one write access MOS transistor and at least one read access MOS transistor, such that write and read operations are independent, said arrays being connected to said input, said at least twelve memory cells within each cell array being dedicated on a one-to-one basis to storing a selected one of said M bits, said at least twelve memory cells within each cell array being individually addressable to sequentially connect said at least twelve memory cells to drive said liquid crystal.

16. A liquid crystal display comprising:

an input of multi-bit pixel data having M bits indicative of color and grayscale; and an array of pixels, each pixel including liquid crystal, a sense amplifier, a DC Balance circuit, a liquid crystal driver and a cell array of M memory cells, said arrays being connected to said input, said memory cells within each cell array being dedicated on a one-to-one basis to storing a selected one of said M bits, said memory cells within each cell array being individually addressable to sequentially connect said memory cells to drive said liquid crystal.

* * * * *